United States Patent [19]

Stupp et al.

[11] Patent Number: 4,484,108

[45] Date of Patent: Nov. 20, 1984

[54] HIGH FREQUENCY BALLAST-IGNITION SYSTEM FOR DISCHARGE LAMPS

[75] Inventors: Edward H. Stupp, Spring Valley; Mark W. Fellows, Monroe, both of N.Y.; Leonard R. Guarnera, New Fairfield, Conn.

[73] Assignee: North American Philips Corporation, New York, N.Y.

[21] Appl. No.: 404,021

[22] Filed: Aug. 2, 1982

[51] Int. Cl.[3] ..... H05B 41/29

[52] U.S. Cl. ..... 315/219; 315/102; 315/105; 315/221; 315/223; 315/282; 315/DIG. 7

[58] Field of Search ..... 315/102, 106, 219, 221, 315/223, 224, DIG. 7, 105, 282

[56] References Cited

U.S. PATENT DOCUMENTS 4,188,661 2/1980 Bower et al. ..... 315/224 X 4,286,194 8/1981 Sherman ..... 315/221 X

*Primary Examiner*—Eugene R. Laroche

*Attorney, Agent, or Firm*—Robert T. Mayer; Bernard Franzblau

[57] ABSTRACT

A high frequency oscillator-inverter ballast-ignition system for a discharge lamp includes a leakage reactance transformer that forms a part of the oscillator-inverter and also couples same to the discharge lamp. An impedance element electrically couples the primary and secondary windings of the transformer in additive phase to provide more reliable lamp ignition over a wider range of voltage and temperature than was heretofore possible. The preheat time period of the lamp cathodes can be better controlled by a proper choice of the transformer heater winding turns.

14 Claims, 4 Drawing Figures

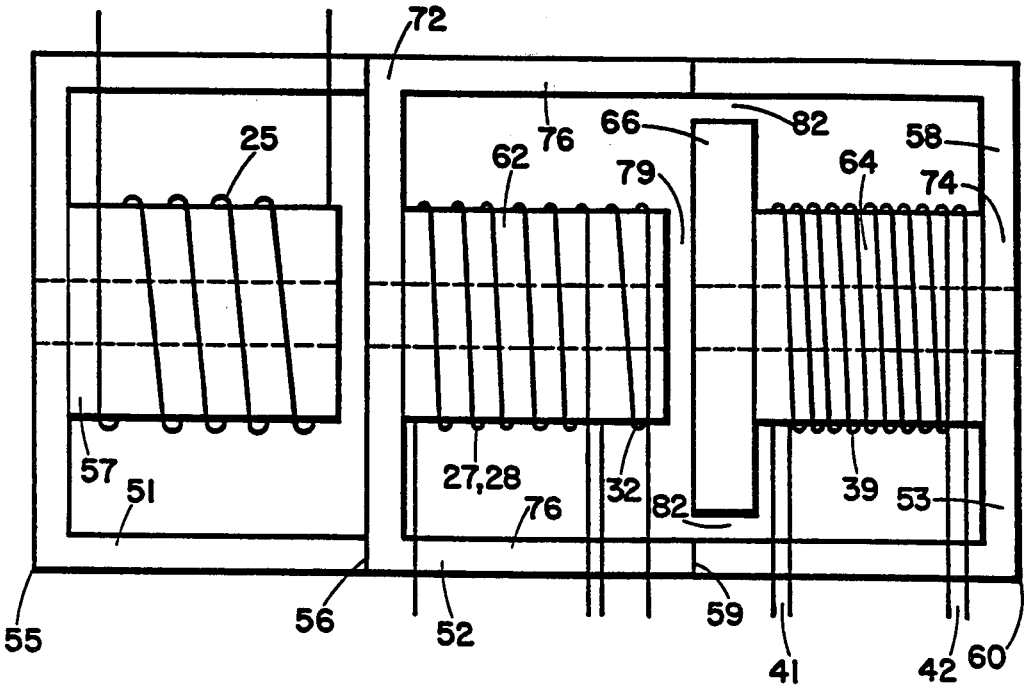
Fig. 3
Fig. 4
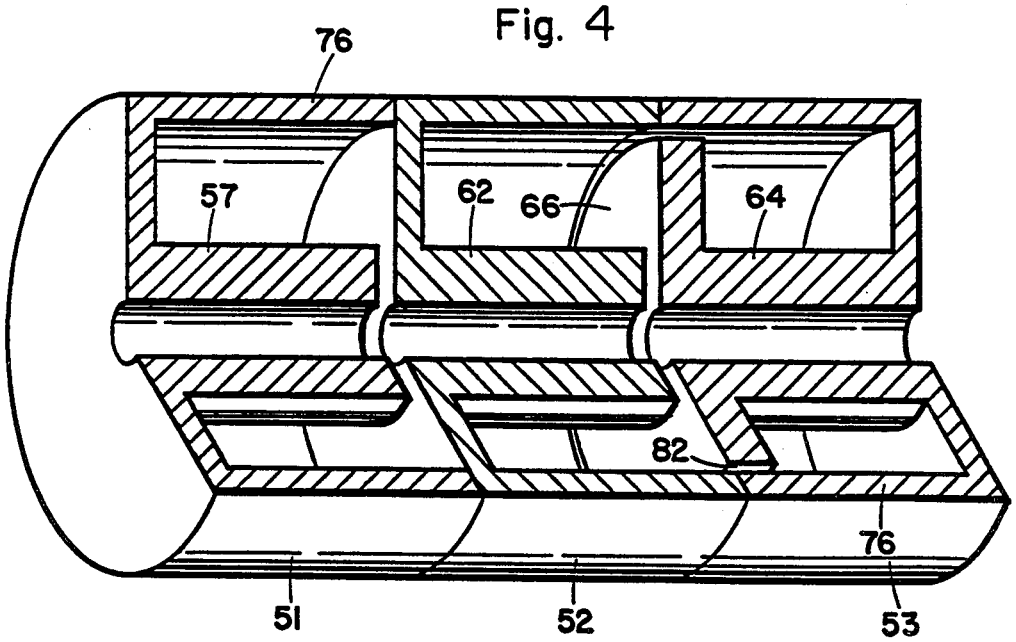

HIGH FREQUENCY BALLAST-IGNITION SYSTEM FOR DISCHARGE LAMPS

BACKGROUND OF THE INVENTION

This invention relates to an improved electronic ballast system for use with a gas discharge lamp. More particularly, the invention relates to an improved form of high frequency ballast control system, e.g. of the type described in U.S. Pat. No. 4,453,109 issued 6/5/84.

The prior art has employed a variety of techniques for energizing and ballasting electric discharge lamps. The early ballast circuits were energized by means of a DC voltage or a 60 Hz AC voltage. In the case of an AC supply voltage, this necessitated the use of a rather large magnetic ballast transformer. These early ballast circuits were characterized by a relatively poor efficiency caused in part by the relatively large power losses in the ballast system itself. More recently it has been proposed to improve the efficiency of a system for energizing discharge lamps by operating the lamps at a high frequency, generally in a range of 15 KHz to 50 KHz.

The invention disclosed in the aforesaid U.S. patent application provides a novel magnetic impedance transformer for coupling an inverter-oscillator to a discharge lamp. A high frequency leakage reactance transformer is used to provide an automatic reduction in the heater power or current supplied to the discharge lamp filament electrodes once the lamp ignites, thereby producing a so-called auto-heat mode of operation. At the same time, the leakage reactance of the transformer also produces a ballast function to protect the discharge lamp. The invention described therein provides a novel structural configuration which minimizes both electromagnetic interference and induction losses.

The aforesaid magnetic transformer, when operated in combination with a high frequency oscillator-inverter controller, provides reliable rapid-start ignition of a compact fluorescent lamp over a temperature range of about 50° F. to 110° F. and with a variation in the input AC line voltage in the range of 108 volts to 132 volts. However, it would be advantageous to be able to operate the discharge lamp system under even lower temperature conditions and with the minimum value of AC line voltage. To do this with the above disclosed system would require an increase in the open circuit voltage (OCV) to the lamp. However, at the high end of the temperature and voltage ranges (110° F. and 132 V) the existing system has just adequate filament heating time to provide rapid-start operation. A further increase in the OCV could result in instant-start operation which would be detrimental to lamp life.

A further limitation on the utility of ballast systems is the adverse affect on lamp ignition produced by high levels of ambient humidity.

SUMMARY OF THE INVENTION

The present invention is an improvement over the apparatus described in U.S. application Ser. No. 382,511 in that it provides better lamp ignition over a wider range of line voltage and a wider temperature range, while reliably insuring rapid-start ignition over the full range of voltage and temperature. Moreover, in the event of a cathode failure in the lamp, the novel improved system provides an automatic changeover to instant-start operation and, as a result, effectively increases the operating life of the overall lamp system.

It is one object of the present invention to widen the useful operating temperature range and input voltage range of a ballast transformer and gas discharge lamp combination.

The present invention is especially adapted for use in combination with a high frequency oscillator-inverter to provide inductive or other ballasting of a gas discharge lamp and automatic control of the lamp filament current to produce optimum cathode temperature before and after lamp ignition, thereby to extend the lamp life and reduce system power losses. This invention retains all of the advantages and unique features of the apparatus disclosed in U.S. application Ser. No. 382,511, the disclosure of which is hereby incorporated by reference into this application.

It is a prime object of the present invention to provide an improved ballast system for a discharge lamp.

A further object of the invention is to provide a ballast system for a discharge lamp having superior lamp ignition characteristics over a wider voltage range and wider temperature range while ensuring rapid-start ignition over the full range of temperature and voltage.

A still further object of the invention is to provide an improved ballast transformer and high frequency controller that produce reliable ignition and operation of a discharge lamp over the full voltage range even with a humidity condition approaching 100%.

Another object of the invention is to provide a novel ballast transformer-discharge lamp combination which extends the useful lamp life.

Although not limited thereto, a preferred embodiment of the invention will be described in connection with an apparatus of the type described in the U.S. application mentioned above. The leakage transformer consists of a hollow ferromagnetic body (e.g. a ferrite material) encapsulating a core including a primary section and a secondary section linearly separated by a first air gap. Part of the secondary section adjacent to the first air gap includes a shunt section having a diameter larger than the core. The shunt section forms a second ring-shaped air gap with the walls of the ferromagnetic body. A primary winding is wound on a part of the primary section and a secondary winding is wound on a part of the secondary section so that the primary and secondary windings are physically separated from one another. A primary flux path is provided which includes the primary and secondary sections and the first air gap. A secondary or shunt flux path is provided which includes the secondary section, the wide diameter shunt section and the second air gap. The primary flux path switches to include the second air gap in response to a predetermined flux flowing in the secondary flux path as a result of current flowing in the secondary winding.

In accordance with the invention, one end of the primary winding is electrically connected to one particular end of the secondary winding by means of an electrical impedance element such that the primary winding and the secondary winding are in additive phase. This connection is made by means of an impedance element which can have a range of values from zero ohms (direct wire connection or the like) up to some large finite value. If DC isolation is desirable, the impedance element may consist of a capacitor. A resistor or inductor could also be used as the impedance element.

In the case of a high frequency oscillator-inverter coupled to the transformer primary winding and a discharge lamp coupled to the secondary winding, if the electrical connection between the primary and secondary windings is made with the proper additive phase, we have observed an unexpected phenomenon, namely that after a short time delay subsequent to the connection of the ballast system to the supply voltage, a sharp increase in the applied voltage appears across the discharge lamp which assists and promotes the ignition thereof. The lamp operating parameters are otherwise unchanged by virtue of the aforesaid electrical connection. Once the lamp ignites, it will operate in a given circuit with the same voltage and current waveforms as though there were no electrical connection between the primary and secondary windings, hence independently of said electrical connection.

However, if the opposite electrical connection is made such that the primary and secondary windings are connected "out of phase", i.e. so that the primary and secondary voltage waveforms are subtractive, then the lamp ignition characteristic will be similar to the situation where there is no direct electrical connection between the primary and secondary windings. Thus, of the two possible phase connections of the primary and secondary windings, only one is effective to improve the discharge lamp starting characteristic.

In contrast to an identical ballast system, but without the electrical connection between the primary and secondary windings, the invention provides reliable lamp ignition at temperatures well below 32° F. and with an input supply voltage of only 108 volts.

A further advantage of the electrical connection in accordance with the invention is that it results in a soft start of the discharge lamp. In a soft start, the peak voltages remain below the value necessary to produce lamp ignition or a glow state for a period of time ($\tau$) sufficient to preheat the lamp cathodes to the operating temperature thereof. The value of $\tau$ can be adjustable, as will be described below.

After the preheat delay time, $\tau$, a sudden increase in voltage occurs which is sufficient to ignite the lamp. If this ballast system is used with a rapid-start discharge lamp, then if a cathode failure occurs, the peak voltage will now be high enough to "instant start" the lamp, thus effectively extending the useful life of the lamp.

Further experiments have revealed that the improved starting operation can also be achieved by connecting the primary winding of the transformer to a wire wrapped around the discharge tube. This suggests that the electrical connection between the primary and secondary windings may be similar in effect to the conventional ground plane starting gate that is traditional in a rapid start lamp system, e.g. one using a TL lamp having individual heater windings as in the system discussed herein.

Typically, an electrical equipotential plane, which could be at ground potential, is located in close proximity, e.g. within one half inch, to the lamp and functions as a lamp starting aid. The presence of this ground plane starting aid results in a reduced level of the open circuit voltage required for lamp ignition and also assists the lamp to ignite at a lower temperature than would be possible without the ground plane. The ground plane is usually returned to the third wire ground of the 60 Hz electric supply system. When a high frequency lamp controller is used to excite such a rapid-start lamp system, the current flowing in the "ground phase" exhibits a unique waveshape.

Upon examination of the current flowing in the electrical connection between the primary and secondary windings of our system, we find a similar current waveform to that which flows in the ground plane of a high frequency excited rapid start lamp system. By adjusting the value of the impedance element between the primary and secondary windings, we can adjust the value of the current flowing therein to the same magnitude as would typically be found in a lamp system that incorporates a ground plane. Thus, in effect, we have produced an electrical equivalent of a ground plane for starting and operating a rapid start lamp system, and without the cost and expense thereof.

We have further discovered another unique feature of the ballast circuit, to wit that we can control the preheat time ($\tau$) of the lamp cathodes by a proper choice of the heater windings of the transformer. In a preferred embodiment of the high frequency ballast system described in U.S. application Ser. No. 382,511, the leakage transformer's secondary winding consisted of a total of 200 turns of wire, including two heater windings of 6 turns each. This produced a heater current of approximately 160 ma in the case of heaters having 12 ohms resistance measured at ambient temperature.

It would be expected that an increase in the number of turns of each heater winding, while maintaining the total number of secondary turns constant, would result in increased heater power (current) and therefore a reduction in the preheat (delay) time. We have found, however, that by increasing the heater windings to 8 turns each, keeping the total secondary turns at 200, an increase of the heater current to about 180–185 ma resulted, but nevertheless produced a longer preheat time ($\tau$) before ignition of the discharge lamp occurred. A further increase in the number of heater winding turns resulted in a reduced level of heater current, e.g. with 11 turns for each heater winding a current of approximately 120 ma was measured. Once again, the preheat time increased before lamp ignition occurred. The preheat time ($\tau$) with ten turn heater windings was between 0.5 and 1 second and with eleven turns it lasted 3–4 seconds. Thus, the preheat time can be adjusted by the choice of the number of heater turns.

It is believed that this unexpected phenomenon is a result of the loading effect produced on the high frequency current fed oscillator-inverter circuit coupled to the primary winding of the leakage transformer by virtue of the reflected impedance of the heater windings into the primary winding. A capacitor is connected in parallel with the transformer primary winding to form a parallel resonant circuit that determines the frequency of oscillation of the oscillator-inverter. Even though the total number of secondary turns remains constant, a change in the heater turns seems to produce an effect on the rate at which the oscillation voltage builds up across the parallel resonant circuit after the system is first connected to a source of supply voltage (switched on). Thus, the impedance of the heater turns (when terminated by the lamp filaments) reflected into the primary produces a loading effect on the oscillator tank circuit that can be used to provide an optimum preheat time for the discharge lamp.

For a given number of heater turns, the heater current remains nominally constant until lamp ignition. This is the result of an increase in heater resistance as the tank voltage builds up. After a preheat delay, the electrical connection between primary and secondary windings described above causes a sharp rise in the lamp voltage to a level sufficient to trigger the lamp into operation. After the lamp ignites, the auto-heat mode of operation occurs as described in the aforesaid U.S. application and in U.S. application Ser. No. 382,734, filed May 27, 1982.

A further object of the invention is to provide an improved high frequency rapid-start ballast system which prevents instant start operation by a simple and inexpensive adjustment of the number of heater winding turns of the leakage transformer.

BRIEF DESCRIPTION OF THE DRAWINGS

Additional objects, features and advantages of the invention will become apparent from the following detailed description of the invention when considered in conjunction with the accompanying drawings, in which:

FIG. 3 shows a cross-section view of a leakage reactance transformer adapted for use in the apparatus of FIG. 1; and FIG. 4 is an isometric view of a part of the leakage transformer.

DETAILED DESCRIPTION OF THE INVENTION

Figure 1:
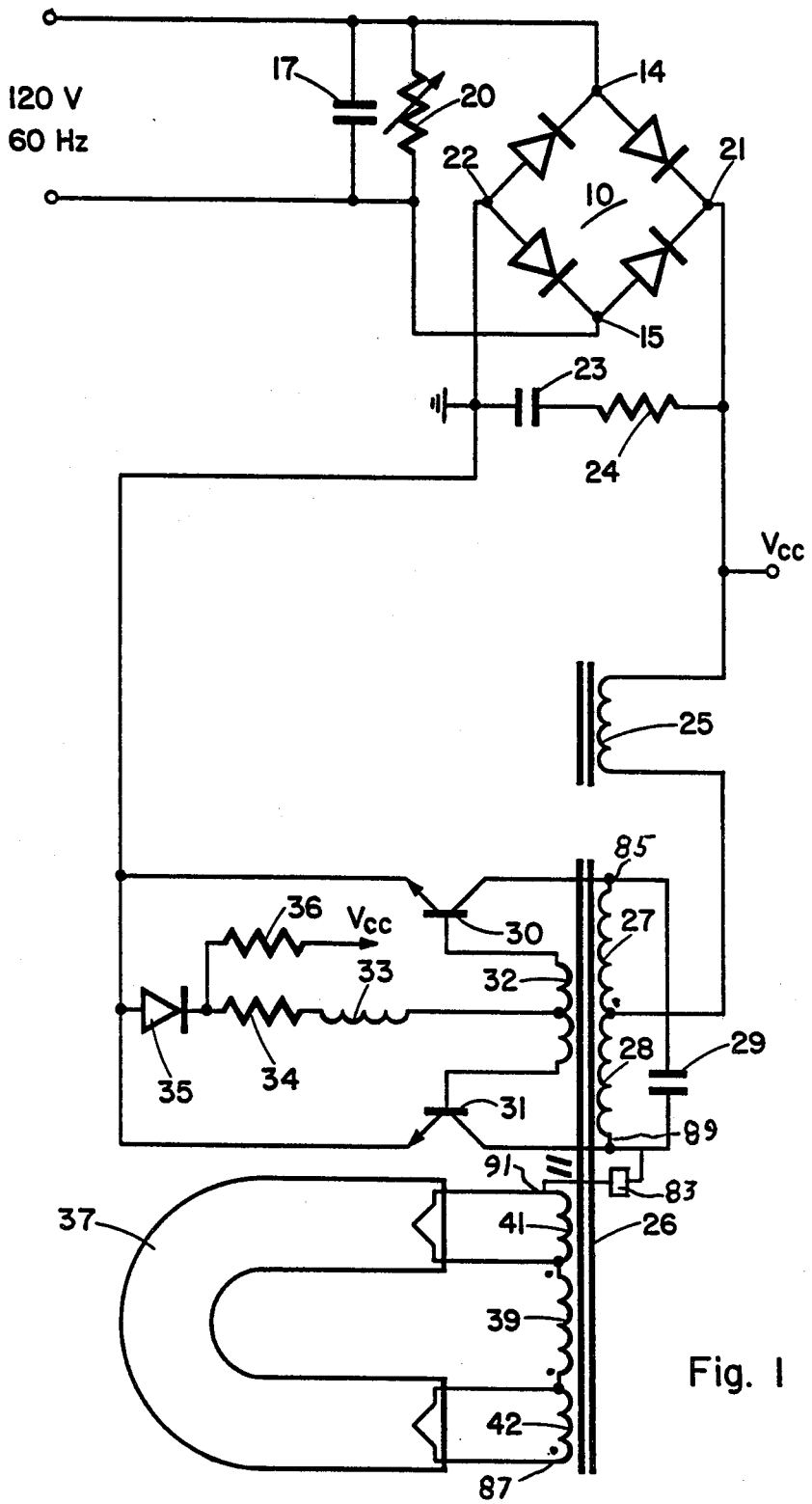
FIG. 1 is an electric schematic diagram of a preferred embodiment of an oscillator-inverter ballast system for a gas discharge lamp.

Referring to FIG. 1 of the drawing, a 120 volt 60 Hz, AC supply voltage is coupled across bridge rectifier 10. Capacitor 17 is connected across bridge input terminals 14 and 15 to provide normal (differential) mode rejection of high frequency conducted radiation. Varistor element 20 is coupled across terminals 14 and 15 to provide transient voltage suppression by virtue of its voltage dependent nonlinear resistance characteristic. Upon the occurrence of a high voltage transient across varistor 20, its impedance changes from a very high value (approximately open circuit) to a relatively low value so as to clamp the transient voltage to a safe level. The inherent capacitance of varistor 20 will provide an added filter function.

Bridge rectifier 10 rectifies the 60 Hz line voltage applied to its input terminals 14, 15 to derive at output terminals 21, 22 a pulsating DC output voltage with a 120 Hz modulation envelope. The maximum voltage will correspond to the peak voltage of the 60 Hz AC input voltage. A capacitor 23 and a resistor 24 are connected in series across the bridge output terminals 21, 22. Smoothing capacitor 23 is chosen so that the minimum supply voltage will insure that a discharge lamp energized thereby does not extinguish at any time within a 60 Hz period of operation. Resistor 24 provides additional transient protection.

Output 21 of rectifier 10 is connected through inductor coil 25 to the center tap of transformer primary winding 27, 28. Inductor coil 25 is formed as part of the structure of the high frequency coupling transformer 26 and is gapped to handle a DC current. Capacitor 29 is connected in parallel with primary winding 27, 28 and has a capacitance value chosen to resonate with the primary inductance at the selected operation frequency of the oscillator-inverter circuit.

NPN switching transistors 30, 31 have their collector electrodes respectively connected to opposite ends of the primary winding 27, 28 and their emitter electrodes connected to output terminal 22 of bridge rectifier 10. This circuit comprises a current fed (via series inductor 25) parallel resonant (27–29) switched mode power oscillator/amplifier. The circuit is extremely efficient in generating a high frequency output and, if all components were ideal (no losses), it would have an efficiency of 100%. A practical circuit will have an efficiency exceeding 95%.

Base drive winding 32 has its end terminals connected to the base electrodes of switching transistors 30 and 31 and its center tap connected to bridge output terminal 22 via a series circuit consisting of inductor 33, resistor 34 and diode 35. Winding 32 and series circuit 33–35 provide one means for deriving the switching drive signals for transistors 30 and 31. Other appropriate base drive circuits for bipolar transistors may also be used.

Starting resistor 36 couples voltage supply $V_{cc}$ (terminal 21) to the junction point between resistor 34 and diode 35 so as to apply a voltage to the base electrodes of the switching transistors in order to start the circuit oscillating. The base drive circuit provides essentially a square wave of current to the transistors so that the transistor switches are driven into a saturation state in the on condition.

The inverter circuit for converting the DC supply voltage into a high frequency AC voltage is thus seen to consist of a pair of active switches, transistors 30, 31, and a tuned parallel resonant circuit 27–29. The transistor switches are driven by the base drive circuit 32–35 so that they act like a two pole switch which defines a rectangular current waveform. As the resonant circuit is tuned to the switching frequency, harmonics are removed by it so that the resultant output voltage is essentially sinusoidal. The choke coil 25 forces essentially a constant DC current into the center tap of primary winding 27, 28. Each switching transistor carries the full DC current when it is on so that the current through each transistor varies from zero to a maximum. The switching transistors conduct in mutually exclusive time intervals.

Discharge lamp 37 is connected to transformer secondary winding 39 and heater windings 41, 42. The discharge lamp may, for example, be a conventional fluorescent lamp, which in the preferred embodiment is an 18 watt lamp. The lamp cathodes are heated by means of transformer secondary windings 41 and 42. The windings will be chosen to provide rapid start ignition of the lamp.

In normal operation, the lamp will not "instant start" because the open circuit voltage across windings 39, 41, 42 is adjusted, by means of the transformer winding turns ratio, to be lower than the value required to instant start the discharge lamp.

In accordance with the invention, an electrical connection consisting of an impedance element 83 has been made from one end of the primary winding of the leakage reactance transformer 26 to one side of the secondary winding so that the primary winding and the secondary winding are in additive phase. The electrical connection is preferably a wire (approximately zero ohms resistance), but can alternatively consist of a resistor or other impedance element which can be adjusted to have a value from zero ohms up to some large finite impedance value. In the case of a 30 KHz circuit tested, a DC isolation capacitor of approximately 50 pf was found to provide good results.

Of the two possible phase connections of the primary winding to the secondary winding, only that one which provides an additive phase is effective to improve the lamp starting characteristics.

As shown by the dot symbols on the transformer windings, the primary and secondary windings have been electrically connected together by the impedance element so that their individual voltages are additive, i.e. the peak voltage from the end 85 of the primary winding to the end 87 of the secondary winding is the sum of the voltages $V_{85,89}+V_{91,87}$. The voltage across the lamp would appear to be unchanged but, since the secondary is part of a leakage reactance transformer, the secondary open circuit voltage will actually be increased slightly due to an increase in the primary/-secondary coupling coefficient from a typical value of 0.9 to 0.95 to a value exceeding 0.95. The system operating characteristics are in all other respects similar to that described for the system of U.S. application Ser. No. 382,511.

Figure 2:
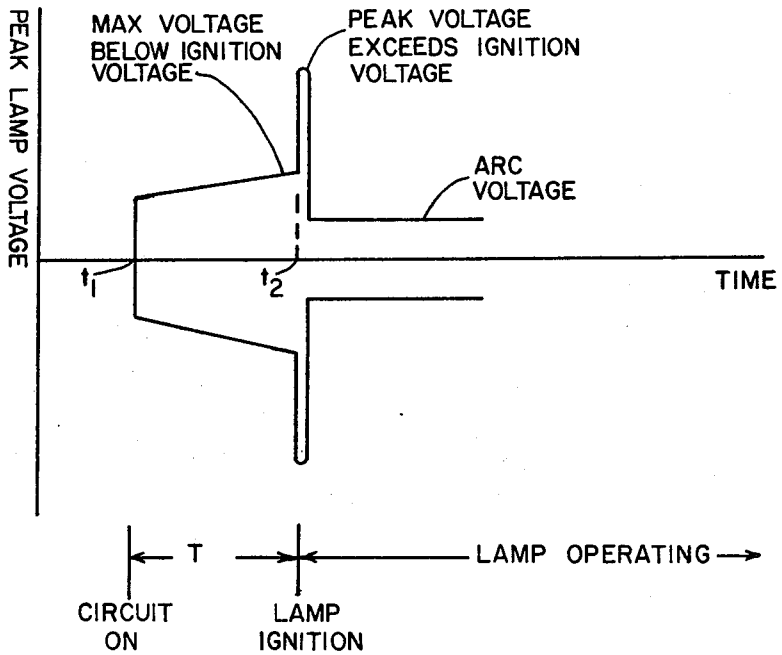
FIG. 2 shows the lamp voltage as a function of time which illustrates the improved operation of the invention.

FIG. 2 illustrates the improved ignition characteristics produced by the invention. After the circuit is switched on at time $t_1$, the peak lamp voltage increases slightly during the preheat time period $\tau$ until at time $t_2$ a sudden surge in the lamp voltage occurs sufficient to ignite the discharge lamp. The lamp voltage subsequently drops to the operating voltage (arc voltage) of the discharge lamp. The preheat time $\tau$ can be varied by adjusting or selecting the number of turns on the heater windings 41, 42.

FIGS. 3 and 4 illustrate an impedance transformation device in the form of a leakage transformer configuration of the type shown in U.S. application Ser. No. 382,511 which provides both a current limiting (ballast) function and an automatic control of the lamp heater power so as to improve the efficiency of the overall power supply-ballast system. The leakage transformer couples the oscillator-inverter circuit to the discharge lamp. Inductive ballasting of the discharge lamp is achieved by means of the leakage reactance of the transformer itself. As shown in FIG. 1, the lamp is connected directly across the transformer secondary winding 39 and the heater windings 41 and 42 so that the varying reactance of the secondary will limit and control the lamp volt-ampere requirements. This leakage transformer arrangement provides a significant reduction in radiated and conducted RFI.

The high frequency leakage transformer comprises a plurality of pot cores 51, 52 and 53 arranged in tandem with each core composed of ferrite material. The choke coil 25 is wound on a cylindrical inner section 57 of the transformer. The pot cores 52 and 53 are joined together at their major openings to form a substantially closed hollow cylinder 58. Cylindrical inner members 62 and 64 carry the primary and secondary windings, respectively. A magnetic disc 66 on the left end of inner cylindrical member 64 forms an air gap 79 with the member 62 and an air gap 82 between the outer edge of the disc and the inner wall of the hollow cylinder 58.

Primary winding 27, 28 consists of 70 turns of preferably bifilar wire. Secondary winding 39 including heater windings 41 and 42 consists of 200 turns of wire. Dependent on the cathode preheat time desired, heater windings 41 and 42 may consist of anywhere from 6 turns each to 11 turns each of wire.

In order to ignite discharge lamp 37 coupled to secondary winding 39, the open circuit voltage across the secondary must exceed the voltage required to initiate a discharge in the lamp. The transformer also provides the power to produce electron emmission of the lamp cathodes, which assists in the initiation of the discharge. Heater windings 41, 42 for the discharge lamp are tightly coupled to the secondary of the transformer such that, when there is no load current flowing, and thus no current in the secondary, the heater windings provide a maximum power transfer to the lamp cathodes.

In operation, before ignition of the discharge lamp, essentially all of the magnetic flux generated by the primary winding 27, 28 links the secondary 39 through the first air gap 79 so as to provide the maximum heater power for the lamp filaments as well as the requisite high open circuit voltage for ignition of the lamp. After ignition, some of the primary magnetic flux is coupled through the second ring-shaped air gap 82 of the transformer so that the flux linkage between the primary and secondary windings decreases, resulting in a reduced cathode heater power. The change in flux coupling to the secondary section is related to the current flowing in the secondary winding and through the lamp. A decrease in lamp current results in an increase of heater current and vice versa so that the heater power bears an inverse relationship to the lamp current. This mode of operation has been termed the auto-heat mode and results in higher efficiency due to the reduction in heater power during lamp operation. Furthermore, the heater power is automatically reduced after ignition of the discharge lamp, thereby providing optimum cathode temperature for extended lamp life. The reduced coupling to the secondary after lamp ignition also provides a leakage reactance for limiting the lamp current.

The magnetic circuit for the primary flux before ignition includes the two ends 72, 74 and the side 76 of hollow cylinder 58, the first and second cylindrical sections 62, 64, disc 66 and first air gap 79. After lamp ignition, a current flows in the secondary winding producing a flux that opposes the primary flux. This causes the magnetic circuit for the primary to change to include one end 72 of hollow cylinder 58, primary cylindrical section 62, first air gap 79, disc 66, second air gap 82 and the side wall 76 of cylinder 58 extending to the end 72. As a result, the flux linkage or coupling to the secondary is reduced after lamp ignition which results in an automatic reduction of the cathode heater power.

The magnetic circuit for the secondary flux after ignition includes the end 74 of hollow cylinder 58, secondary cylindrical section 64, disc 66, second air gap 82 and the walls 76 of cylinder 58 extending to the end 74 of cylinder 58.

It will be understood that various modifications to the above described arrangement will become evident to those skilled in the art without departing from the spirit and scope of the invention as defined in the appended claims.

We claim:

1. A high-frequency ballast circuit for starting and operating an electric discharge lamp from a low frequency AC power source comprising, a high frequency oscillator-inverter circuit adapted to be energized from said low frequency AC power source, a leakage reactance transformer having a primary winding coupled to the oscillator-inverter, a secondary winding and at least one heater winding, a capacitor coupled to the transformer primary winding to form a resonant circuit that determines the oscillation frequency of said oscillator-inverter, means for coupling the secondary winding and the heater winding to an electric discharge lamp to provide a preheat time period for the lamp, and impedance means electrically connecting said primary and secondary windings together in additive phase so as to produce a sudden increase in the amplitude of ignition voltage developed across the secondary winding at the end of said preheat time period.

2. A high-frequency ballast circuit as claimed in claim 1 wherein the lamp is of a type having a preheatable cathode and said heater winding has a number of turns such as to provide a desired preheat time period for the lamp cathode prior to lamp ignition whereby said preheat time period is determined by the number of turns of the heater winding.

3. A ballast circuit as claimed in claims 1 or 2 wherein the leakage transformer comprises a magnetic core having first and second magnetic legs on which said primary and secondary windings are wound, respectively, so as to provide a physical separation therebetween, said heater winding being wound on said second leg, and wherein said magnetic core includes at least one air gap arranged to provide a leakage reactance characteristic in said transformer.

4. A ballast circuit as claimed in claim 2, wherein said heater winding comprises a portion of the secondary winding derived from a tap connection on said secondary winding whereby the preheat time period increases as the number of heater winding turns is increased and with the total number of turns of secondary winding approximately constant.

5. A ballast circuit as claimed in claims 1 or 2 wherein said impedance means comprises an electrical wire.

6. A ballast circuit as claimed in claims 1 or 2 wherein said impedance means comprises a resistor.

7. A ballast circuit as claimed in claims 1 or 2 wherein said impedance means comprises a capacitor.

8. A ballast circuit as claimed in claims 1 or 2 wherein said impedance means comprises an inductor.

9. A ballast circuit as claimed in claim 1 wherein the lamp includes at least one preheatable cathode and said resonant circuit is a parallel resonant circuit, the transformer primary and secondary windings having a turns ratio that produces a voltage at said secondary winding that is below the lamp ignition voltage during said preheat period.

10. A high-frequency ballast circuit for starting and operating an electric discharge lamp from a low frequency AC power source comprising, a high frequency oscillator-inverter circuit adapted to be energized from said low frequency AC power source, a leakage reactance transformer having a primary winding coupled to the oscillator-inverter, a secondary winding and at least one heater winding, a capacitor coupled to the transformer primary winding to form a resonant circuit that determines the oscillation frequency of said oscillator-inverter, and means for coupling the secondary winding and the heater winding to an electric discharge lamp, and wherein the number of turns of said heater winding provide a desired preheat time period for the lamp cathode prior to lamp ignition and said preheat time period is directly proportional to the number of turns of the heater winding.

11. A high-frequency ballast circuit as claimed in claims 1 or 10 wherein said coupling means connects the secondary winding in parallel with a discharge lamp.

12. A high-frequency ballast circuit as claimed in claims 1 or 10 wherein the lamp cathode heater current is a peaking function in which the current increases, reaches a peak value, then decreases as the number of turns of the heater winding is increased, said peak value being determined by the number of turns of the heater winding.

13. A ballast circuit as claimed in claim 10 wherein said lamp is of a type having at least one preheatable cathode, and means electrically connecting a terminal of the primary winding to a terminal of the secondary winding so that said primary and secondary windings are connected together in additive phase relationship, said ballast circuit producing a sharp increase in the amplitude of the transformer secondary voltage at the end of the preheat time period of a value greater than the lamp ignition voltage.

14. A high frequency circuit for starting and operating an electric discharge lamp of a type having one or more preheatable electrodes comprising, a pair of input terminals for connection to a low frequency AC voltage source with a voltage that can vary within a range of $\pm 10\%$ about a nominal operating voltage level, a high frequency oscillator-inverter circuit coupled to said input terminals, said oscillator-inverter circuit including a transformer having a primary winding and a capacitor coupled thereto to form a resonant circuit that determines the oscillation frequency of said oscillator-inverter, said transformer having a secondary winding and a heating winding, means for coupling the secondary winding and the heater winding to the discharge lamp, the transformer having a turns ratio such that a voltage is developed across the secondary winding that is below the lamp ignition voltage for all values of the AC voltage within said range of voltages, and means electrically connecting said primary and secondary windings together in additive phase whereby said developed voltage appears at the secondary winding for a preheat time period sufficient to heat a lamp electrode to normal operating temperature whereupon a sharp increase in the amplitude of the secondary voltage is produced by the circuit which is above the lamp ignition voltage thereby to provide a delayed ignition of a lamp.

* * * * *